US006584738B1

(12) United States Patent
Andräet al.

(10) Patent No.: US 6,584,738 B1
(45) Date of Patent: Jul. 1, 2003

(54) CLAMPING DEVICE FOR A BAND-SHAPED TENSIONAL MEMBER

(75) Inventors: Hans-Peter Andrä, Stuttgart (DE); Markus Maier, Plieningen (DE); Dieter Sandner, Weinstadt (DE)

(73) Assignee: Leonhardt Andrä und Partner Beratende Ingenieure VBI GmbH, Stuttgart (DE)

( * ) Notice: Subject to any disclaimer, the term of this patent is extended or adjusted under 35 U.S.C. 154(b) by 0 days.

(21) Appl. No.: 09/806,449

(22) PCT Filed: Aug. 19, 1999

(86) PCT No.: PCT/EP99/06066

§ 371 (c)(1),
(2), (4) Date: Aug. 2, 2001

(87) PCT Pub. No.: WO00/24989

PCT Pub. Date: May 4, 2000

(30) Foreign Application Priority Data

Oct. 28, 1998 (DE) ..... 198 49 605

(51) Int. Cl.[7] ..... E04G 23/02

(52) U.S. Cl. ..... 52/223.14; 52/223.6; 52/223.13; 52/745.21

(58) Field of Search ..... 52/223.6, 223.7, 52/223.8, 223.9, 223.11, 223.13, 223.14, 730.2, 724.2, 724.5, 601, 745.21

(56) References Cited

U.S. PATENT DOCUMENTS

| | | | | | |
|---|---|---|---|---|---|
| 3,722,158 | A | * | 3/1973 | Dykmans | 52/223.13 |
| 4,648,146 | A | * | 3/1987 | Nutzel et al. | 14/21 |
| 5,479,748 | A | * | 1/1996 | Siller | 52/231 |
| 6,247,279 | B1 | * | 6/2001 | Murat et al. | 52/223.3 |
| 6,318,038 | B1 | * | 11/2001 | Park | 52/223.13 |
| 6,385,940 | B1 | * | 5/2002 | Maier et al. | 52/730.2 |

FOREIGN PATENT DOCUMENTS

| | | | | | |
|---|---|---|---|---|---|
| DE | 1097114 | A | * | 1/1961 | 52/223.13 |
| DE | 197 42 210 | | | 3/1999 | |
| FR | 2 594 871 | | | 8/1987 | |
| JP | 402266050 | A | * | 10/1990 | 52/223.13 |

* cited by examiner

*Primary Examiner*—Carl D. Friedman
*Assistant Examiner*—Brian E. Glessner
(74) *Attorney, Agent, or Firm*—Burns, Doane, Swecker & Mathis, LLP

(57) ABSTRACT

A concrete tensioning band is disposed on a surface of unhardened concrete and tensioned by being attached to a clamp disposed on the base, and then displacing the clamp by a drive mechanism disposed on the clamp. Such displacement serves to tension the band. Spacers are positioned between the clamp and the base to hold the clamp in the displaced state while the drive mechanism is removed and an anchor device is fixed to the band to anchor the band to the base. Then, the clamp is removed.

3 Claims, 2 Drawing Sheets

CLAMPING DEVICE FOR A BAND-SHAPED TENSIONAL MEMBER

BACKGROUND OF THE INVENTION

The invention relates to a clamping device for a band-shaped tensional member on a concrete surface of a supporting structure.

For increase in load capacity (strengthening) or for restoration to the original load capacity (reconstruction) of supporting structures made of reinforced concrete or prestressed concrete, it has been known to later attach prestressed tensional members on the outside of the supporting structure. For example, brackets made of steel or reinforced concrete are attached with dowels (bolts) to the concrete surface for anchoring and the tensional member is then tensioned between said brackets. However, through displacement between the axis of the tensional member and the concrete surface there develops an unfavorable displacement moment, which is to be taken up and transferred in the bracket anchoring; in addition, a bond between the tensional member and the concrete surface cannot be obtained.

The required prestress has to be applied to the band-shaped tensional member that rests on the concrete surface as long as the adhesive layer between the band-shaped tensional member and the concrete surface has not hardened (cured). Both ends of the prestressed band-shaped tensional member must be durably connected to the supporting structure. A clamping device of the present type serves for this purpose.

A clamping drive is necessary for the application of prestress, which has for instance one or more hydraulic cylinders. However, these clamping drives must be removable so that they can be reused again. Therefore durable anchoring of the band-shaped tensional member is necessary after completion of the clamping process. This anchoring should be made in such a manner that only a small part protrudes from the concrete surface to make protection against corrosion possible in a simple way.

It is therefore the object of the invention to provide a clamping device of the type mentioned in the beginning that makes possible in a simple manner the application of a prestress force and an effective anchoring of the band-shaped tensional member whereby the least possible number of components will remain permanently at the clamping site.

SUMMARY OF THE INVENTION

This object is achieved according to the invention whereby in a base mounting, which is durably joined to the supporting structure, there is a clamping slide detachably joined to the band-shaped tensional member by clamping and which, in turn, is arranged so it may be longitudinally guided and removed. A clamping drive is detachably mounted between the clamping slide and the base mounting, whereby at least one spacer may be inserted between facing abutment surfaces of the base mounting and the clamping slide, and whereby an anchoring device may be durably connected to the band-shaped tensional member and the base mounting.

The use of a clamping slide, which only temporarily engages the band-shaped tensional member during the clamping process, and an anchoring device which bonds permanently with the band-shaped tensional member only after the clamping process, make it possible to remove all components that are necessary for the clamping process after completion of the clamping process and to re-use said components for pre-stressing of additional band-shaped tensional members. The anchoring device, which remains continuously connected to the band-shaped member, may be designed having only a few simple components.

The base mounting preferably consists of a base plate and guides for the clamping slide that is detachably mounted thereon, preferably by bolts whereby said base plate may be advantageously and durably joined with the supporting structure by adhesion. This divided configuration of the base mounting makes possible to remove the guides after completion of the clamping process and to leave only the base plate permanently attached to the supporting structure whereby said guides are needed only temporarily during the clamping process.

According to a preferred embodiment of the invention, it is proposed that the clamping sled consist of a lower plate and a clamping plate bolted thereto whereby the band-shaped tensional member may be clamped in between. This configuration makes possible, on one hand, a simple clamping connection between the clamping slide and the band-shaped tensional member, and on the other hand, the clamping slide may be removed in a simple way from the band-shaped tensional member after completion of the clamping process and anchoring of said tensional member by an anchoring device.

According to another preferred embodiment of the invention, the anchoring device has a clamping anchor plate that may be bolted to the base plate while clamping down the band-shaped tensional member. Preferably, the clamping anchor plate may additionally be glued to the band-shaped tensional member.

This combination of clamping and gluing in the region of the anchoring device increases the safety of the tensile force transmission in the anchoring area since the adhesive bond is added to the static friction caused by the clamping pressure. Thereby a durable anchoring of the band-shaped tensional member is guaranteed even after decreasing the prestress forces of the bolt on the clamp. In addition, the problem of corrosion protection in the clamping joint is solved by the application of an adhesive.

BRIEF DESCRIPTION OF THE DRAWING

An embodiment example of the invention is described below in more detail with reference to the accompanying drawings.

DETAILED DESCRIPTION OF A PREFERRED EMBODIMENT OF THE INVENTION

Figure 1:
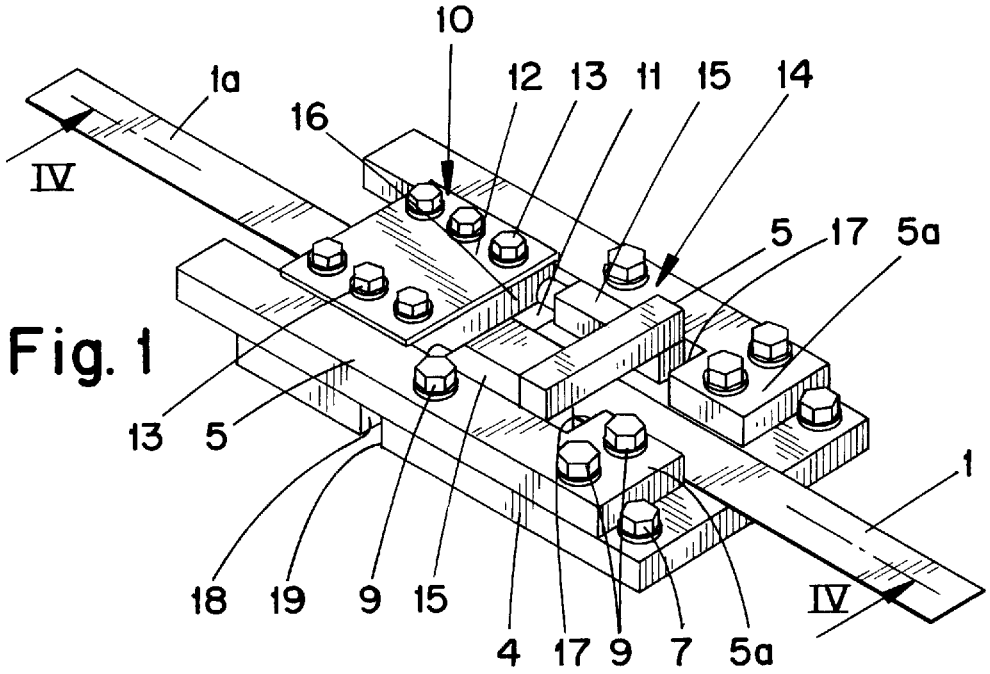
FIG. 1 shows in a spatial view of a clamping device for a band-shaped tensional member on a concrete surface of a supporting structure whereby the clamping deice is depicted in a clamping mode.

The clamping device illustrated in the drawing serves to prestress a band-shaped tensional member 1 before the adhesive joint between the tensional member 1 and a concrete surface 2 has hardened whereby said clamping device is a steel plate, for example, that is attached to a concrete surface 2 of a supporting structure 3 by means of an application of adhesive. Said clamping device also serves to anchor to the supporting structure the segment of the tensional member 1 that lies in the area of the clamping device.

The clamping device has a base mounting, which includes a base plate 4 and lateral guides 5 bolted thereto. The base plate 4 is durably attached in a recess 6 of the concrete surface 2 by means of anchor bolts 7 and an adhesive layer 8.

The guides 5, which are designed as lateral longitudinal rails, are detachably mounted to the base plate 4 by means of bolts 9.

A clamping slide 10 is slidably guided in the longitudinal direction of the tensional member 1 between the two lateral guides 5, which extend from the base plate 4 in the direction of the flexible extension la of said tensional member 1. The clamping slide 10 consists of a lower plate 11, which is arranged underneath the band-shaped tensional member 1 and which reaches laterally under the guides 5, and a clamping plate 12 bolted thereto, which is disposed on the upper side of the band-shaped tensional member and which reaches laterally over the top of the guides 5. The band-shaped tensional member 1 is fastened to the clamping slide 10 by clamping through tightening of bolts 13 that connected the lower plate 11 with the clamping plate 12.

A clamping drive 14, which has two hydraulic cylinders 15 in the illustrated embodiment example, is inserted between the face 16 of the clamping plate 12 of the clamping slide and a corresponding support surface 17 of an angled segment 5*a* of the guides 5 of the base mounting. Tensional prestress is applied to the band-shaped tensional member 1 through actuation of the clamping drive 14 as long as the adhesive layer between the tensional member 1 and the concrete surface 2 has not hardened. After reaching the preset tensional prestress value, fitted spacers 20 (FIG. 2) are inserted between the facing abutment surfaces 18 and 19 of the clamping slide 10 or the base plate 4. The clamping drive 14 is subsequently loosened and removed from said clamping device.

Figure 2:
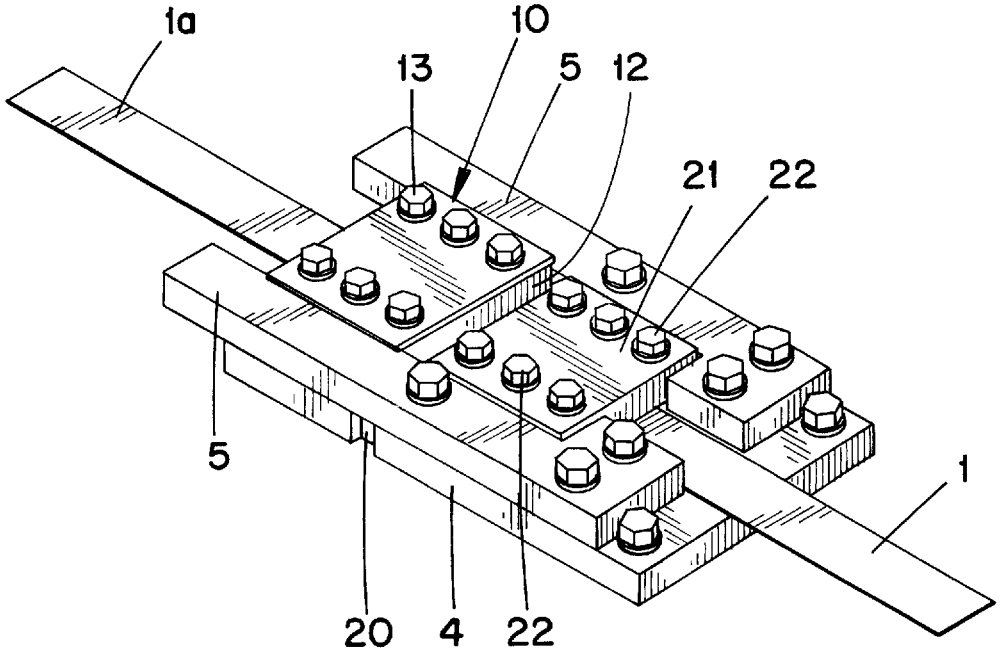
FIG. 2 shows the clamping device according to FIG. 1 after completion of the clamping process and after attachment of a permanent anchoring device.

A clamping anchor plate 21 is now inserted in the area in which the clamping drive 14 was previously mounted (FIG. 2), whereby an adhesive application is added between the underside of the clamping anchor plate 21 and the upper side of the band-shaped tensional member 1. The clamping anchor plate 21 is bolted to the base plate 4 by means of bolts 22 whereby said band-shaped tensional member 1 is clamped down. This condition is shown in FIG. 2.

The clamping slide 10 is subsequently loosened from the tensional member 1 by loosening the bolts 13, and the lateral guides 5 are removed from the base plate 4 after loosening of the bolts 9 and after the adhesive bond has hardened between the clamping anchor plate 21 and the tensional member 1. The anchoring device 23 (shown in FIG. 3) remains in the recess 6 of the concrete surface 2 whereby said anchoring device consists of the base plate 4 and the clamping anchor plate 21 bolted thereto. The tensional member 1 is durably connected with the anchoring device 23 by clamping and gluing. An anticorrosive agent is applied subsequently.

Figure 3:
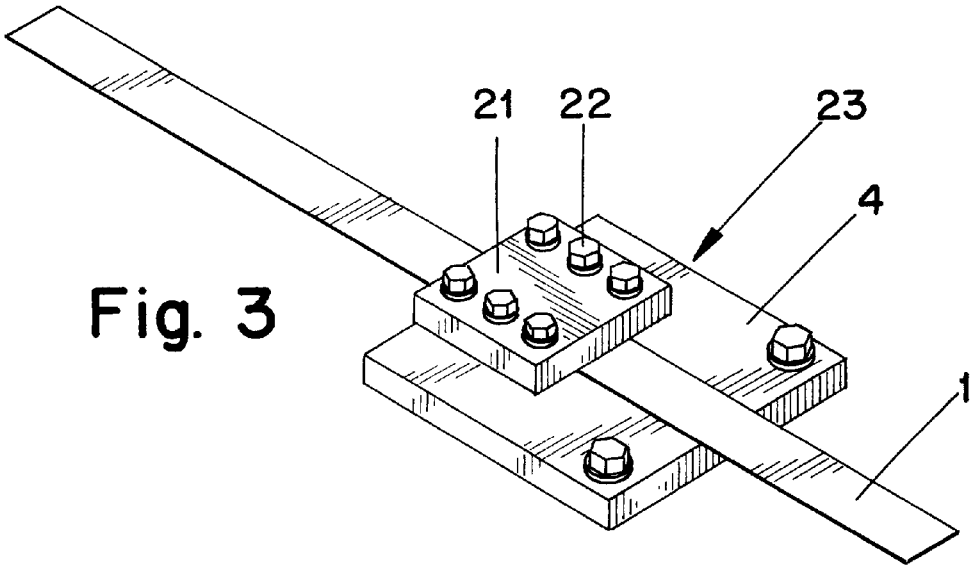
FIG. 3 shows the remaining anchoring device after the removal of substantial parts of the clamping device according to FIGS. 1 and 2.
Figure 4:
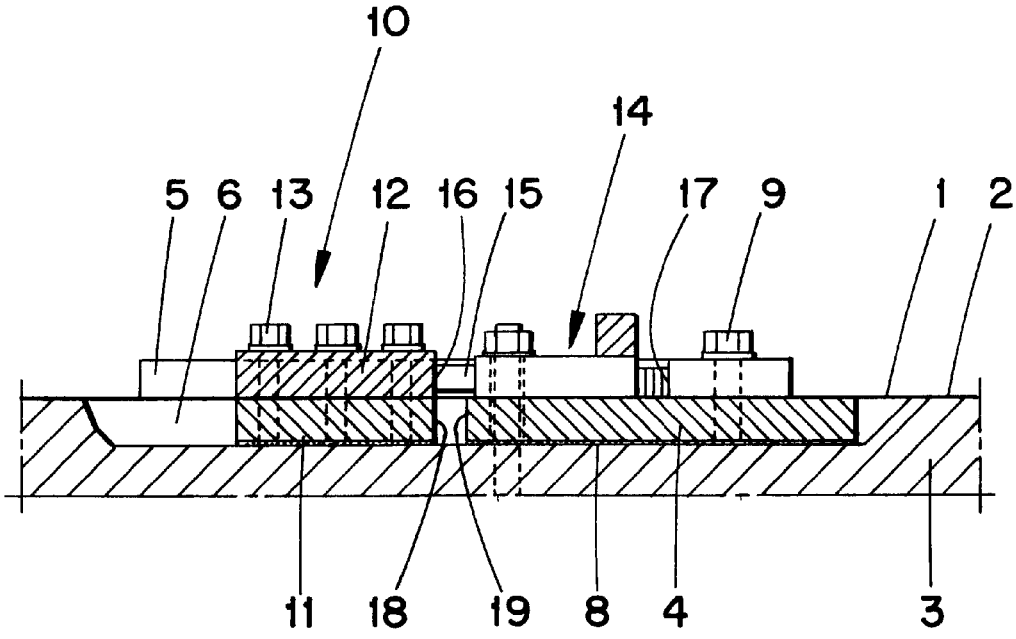
FIG. 4 shows a sectional view taken along line IV–IV in FIG. 1.

The band-shaped tensional member 1 is anchored at its other end by means of an anchoring device, which corresponds to the described anchoring device 23 as illustrated in FIG. 3.

The removed components of the clamping device, which were removed after completion of the described prestress process and after permanent anchoring, may be reused for the prestress process of additional tensional members 1. Said removed components include the clamping drive 14, the guides 5 and the clamping slide 10.

What is claimed is:

1. A tensioning system for tensioning a band-shaped tensional member disposed on a surface of an unhardened concrete supporting structure, the system comprising:

a base mounting configured to be secured to the concrete supporting structure;

a clamping slide adapted to be slidably mounted to the base mounting and releasably clamped to the band-shaped tensional member;

a clamping drive adapted to be detachably mounted to the base mounting for displacing the clamping slide relative to the base mounting to tension the band-shaped tensional member;

a spacer configured to be placed between the clamping slide and the base mounting for holding the clamping slide in a displaced state; and an anchoring device securable to both the band-shaped tensional member and the base mounting for holding the band-shaped tensional member in a tensional state to enable the clamping slide, the clamping drive, and the spacer to be dispensed with;

wherein the base mounting comprises a base plate and guides removably attached to the base plate for guiding the clamping slide for sliding movement;

wherein the clamping slide comprises a lower plate and a clamping plate securable to the lower plate, with the band-shaped tensional member clamped therebetween.

2. The tensioning system according to claim 1 wherein the anchoring device comprises an anchor plate adapted to be bolted to the base mounting.

3. A method of tensioning a band-shaped tensional member comprising the steps of:

A) arranging the band-shaped tensional member on a concrete surface of a concrete supporting structure prior to hardening whereby an end portion of the band-shaped tensional member extends across a base mounting fixedly mounted in the supporting structure;

B) releasably clamping the band-shaped tensional member to a clamp disposed on the base mounting;

C) actuating a drive mechanism removably disposed on the base mounting to displace the clamp relative to the base mounting in a direction causing the band-shaped tensional member to be tensional;

D) inserting a spacer between the clamp and the base mounting to retain the clamp in the displaced state;

E) removing the drive mechanism from the base mounting;

F) securing an anchoring member to both the band-shaped tensional member and the base mounting; and G) removing the clamp from the band-shaped tensional member and the base mounting.

* * * * *